US007489412B2

(12) United States Patent
Wamemünde et al.

(10) Patent No.: US 7,489,412 B2
(45) Date of Patent: Feb. 10, 2009

(54) METHOD AND DEVICE FOR DETERMINING THE SPATIAL GEOMETRY OF A CURVED EXTRUDED PROFILE

(75) Inventors: Ralf Wamemünde, Osterweddingen (DE); Dirk Berndt, Magdeburg (DE)

(73) Assignee: Fraunhofer Gesellschaft zur Förderung der angewandten Forschung e.V., München (DE)

( * ) Notice: Subject to any disclaimer, the term of this patent is extended or adjusted under 35 U.S.C. 154(b) by 469 days.

(21) Appl. No.: 10/482,208

(22) PCT Filed: Jun. 27, 2002

(86) PCT No.: PCT/EP02/07121

§ 371 (c)(1),
(2), (4) Date: Aug. 16, 2004

(87) PCT Pub. No.: WO03/002280

PCT Pub. Date: Jan. 9, 2003

(65) Prior Publication Data

US 2004/0257589 A1 Dec. 23, 2004

(30) Foreign Application Priority Data

Jun. 27, 2001 (DE) ..... 101 30 937

(51) Int. Cl.
*G01B 11/14* (2006.01)
*G01B 11/24* (2006.01)

(52) U.S. Cl. ..... 356/625; 356/602

(58) Field of Classification Search ..... 72/31.13, 72/256; 356/602–605, 612, 625, 601
See application file for complete search history.

(56) References Cited

U.S. PATENT DOCUMENTS

| | | | | | |
|---|---|---|---|---|---|
| 4,972,090 | A | * | 11/1990 | Eaton | 250/559.13 |
| 5,008,555 | A | * | 4/1991 | Mundy | 250/559.22 |
| 5,046,852 | A | * | 9/1991 | Hametner et al. | 356/398 |
| 5,289,261 | A | * | 2/1994 | Yogo et al. | 356/611 |
| 5,305,223 | A | | 4/1994 | Saegusa | |
| 5,774,220 | A | * | 6/1998 | Wienecke | 356/608 |
| 5,797,289 | A | | 8/1998 | Hoshino | |
| 5,836,188 | A | * | 11/1998 | Mahan et al. | 72/21.4 |
| 5,992,210 | A | | 11/1999 | Blurton-Jones | |
| 5,994,410 | A | * | 11/1999 | Chiang et al. | 514/709 |
| 6,094,269 | A | * | 7/2000 | Ben-Dove et al. | 356/623 |
| 6,345,525 | B1 | * | 2/2002 | Bruyas et al. | 72/307 |
| 6,954,679 | B1 | * | 10/2005 | Takeda et al. | 700/165 |

FOREIGN PATENT DOCUMENTS

| | | | |
|---|---|---|---|
| CH | 689 378 | A5 | 3/1999 |
| DE | 43 35 901 | A1 | 10/1993 |
| DE | 43 30 420 | A1 | 3/1995 |
| DE | 44 36 442 | A1 | 4/1996 |

(Continued)

*Primary Examiner*—Gregory J Toatley, Jr.
*Assistant Examiner*—Scott M Richey
(74) *Attorney, Agent, or Firm*—Cook Alex Ltd.

(57) ABSTRACT

Devices and methods for bending an extruded section of material held in a feed and fixing unit to yield a material with one or more bends and yielding a three-dimensional shape. In addition, devices and methods for further determining the three-dimensional geometry of the bent extruded section of material after one or more bending operations.

21 Claims, 1 Drawing Sheet

FOREIGN PATENT DOCUMENTS

Figure 1:
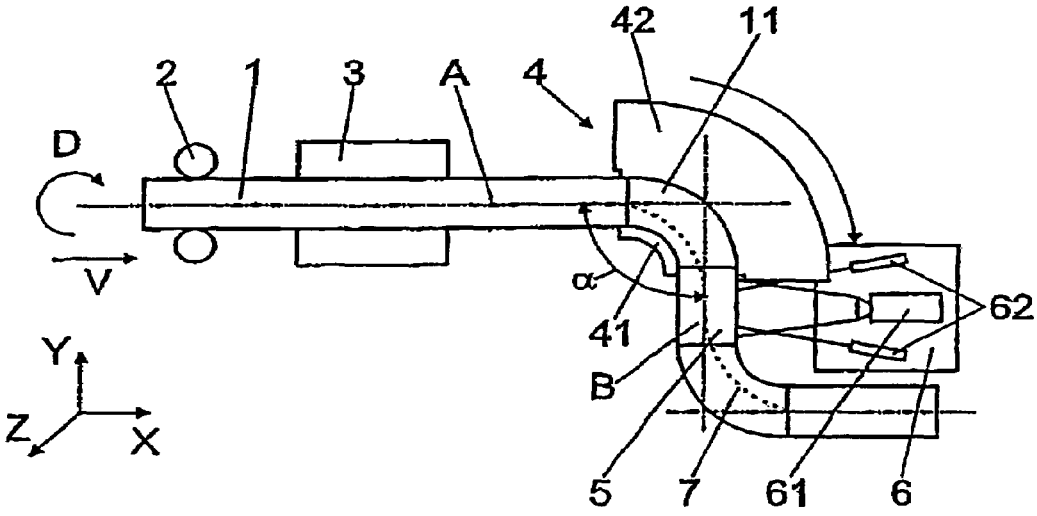

| | | | |
|---|---|---|---|
| DE | 195 30 805 | A1 | 2/1997 |
| DE | 196 00 176 | A1 | 7/1997 |
| DE | 197 12 685 | A1 | 10/1998 |
| DE | 197 46 219 | A1 | 4/1999 |
| EP | 0 928 647 | A2 | 7/1999 |
| WO | PCT/EP02/07121 | | 7/2002 |

* cited by examiner

METHOD AND DEVICE FOR DETERMINING THE SPATIAL GEOMETRY OF A CURVED EXTRUDED PROFILE

TECHNICAL FIELD

The invention relates to a method and a device for determining the three-dimensional geometry of a bent extruded section, in particular a tube, which is held in a feed and fixing unit in the region along a first rectilinear center axis (A) of the extruded section and is bent through a predeterminable bending angle α by means of a bending device, in such a manner that the region of the first rectilinear center axis (A) adjoins one side of a bent region of the extruded section which has been produced by the bending operation and a region having a second rectilinear center axis (B) adjoins the opposite side.

PRIOR ART

Extruded sections in the present sense are elements of rod-like formation which are in the form of products sold by the meter, having a minimum rigidity along their extent on account of the production processes and materials employed and can be subjected to a plastic bending process for the purpose of three-dimensional deformation, this bending process giving rise to a permanent plastic bending deformation in the sense of a permanent curvature. This applies in particular to tubes or extruded sections made from solid material which consist of metal and which have to be deformed individually as a function of their subsequent use.

The further statements given below relate primarily to tubes as hollow lines consisting of plastically deformable material, preferably metal, but the statements given below can also be transferred to extruded sections of other geometries and shapes in which measures which change the three-dimensional shape are to be taken.

Tubes are used, for example, in the form of pipeline systems for transferring or carrying gaseous or liquid media and, depending on the local conditions, have curved or tube bends along their extent. By way of example, in this context reference is made to the pipeline system made from metal which is used in the automotive sector and, filled with brake fluid, is used to transmit braking forces. High demands relating to sealing and mechanical stability are imposed on a pipeline system of this type, and consequently the pipelines, which generally have a length of several meters, are produced as a single piece, despite the fact that a large number of bends and curves are provided along the corresponding profile of the pipeline, on account of the very restricted space available in motor vehicles.

Tubes of this type, the cross section of which generally measures a few mm to cm, in order to be processed, are introduced into corresponding bending devices in which the tube which is to be bent is fixed on one side and is locally deformed by means of a bending head. Examples of bending devices which are known for this purpose are described in DE 43 35 901 A1, DE 195 30 805 A1 and CH 689 378 A5. Bending machines can in principle be divided into two categories, namely bending machines with a stationary bending head, in which the tube which is to be bent is fed to a stationary bending head, which generally comprises two bending jaws, by means of a feed and fixing unit and is correspondingly plastically deformed by bringing the two bending jaws together. Bending machines belonging to the other category provide a moving bending head, in which a bending head, which executes translational and rotary movements and is locally pressed onto the tube at a suitable location in order to produce a curvature, is moved relative to a fixed tube.

To monitor and check the quality of the bending results, the tube, in a manner which is known per se, is completely removed from the bending device and is correspondingly checked as a separate individual piece. Both systems which operate with contact, i.e. tactile systems, and systems which operate contactlessly, predominantly measurement systems which are optically based, are used for this checking operation. Tactile measurement systems include what are known as coordinate-measuring machines or jointed measurement arms, by means of which the bent tube surface is scanned in punctiform fashion at a large number of surface regions, so that a number of three-dimensional coordinate points based on a reference coordinate system is obtained, from which the overall geometry of the bent tube can be calculated by subsequent mathematical approximation.

Alternatively, methods which operate contactlessly provide for the bent tube to be scanned with the aid of punctiform or linear triangulation methods or photogrammetry methods in order likewise to determine the tube geometry using mathematical evaluation methods.

Methods for determining the three-dimensional tube geometry which operate with the aid of fork-like arrangements using optical light barriers which are moved longitudinally with respect to the extent of the bent tube, recording 3-D surface points, which, as described above, are fed to a mathematical evaluation algorithm in order for the three-dimensional geometry to be determined, are also known.

For example, DE 43 30 420 A1 describes a tube-bending machine having a bending head which is supported by a carriage and has a first bending roll, which is stationary with respect to a housing of the bending head, and a second bending roll, which is arranged on a bending arm. The axes of the bending rolls run parallel to one another and perpendicular to the axis of the tube which is to be bent. Furthermore, there are two drive motors, one of which is used to displace the carriage along a guide and therefore to displace the bending head along the tube, while a second drive motor is used to pivot the bending arm about the axis of the first bending roll. An angle-measuring pick-up, which can be used to record the bending angle (α) of the bending arm, is provided in the transmission between the second drive motor and the bending head. The respective position of the bending arm with bending roll is transmitted by the angle-measuring pick-up to a circuit, with the bending angle being determined by a comparison between set and actual value.

Therefore, with the circuit described in this document, it is only possible to compare the actual value of the movement of the bending arm which has taken place with a set value which is to be input into the control. The springback of the tube which results after the clamping device has been released from the tube, however, is not and cannot be taken into account with this device, since the bending angle is only determined in the clamped position of the tube.

DE 197 46 219 A1, which describes a bending machine for bending material in rod form, goes one step further in this respect. The material in rod form, in particular a tube, is held at a partial piece and at a tube section to be bent which adjoins this partial piece. Then, the tube section which is to be bent is bent through a predeterminable angle and the springback of the bent tube is measured, so that the tube can be bent further if necessary. After the clamping device has been released, the springback on the bent tube section is measured. This is done using a sensor pin which bears against the outside of the tube wall and transmits the movement of the tube limb relative to the bending tool, which is held in position, as it springs open to a rotational displacement pick-up. This makes the degree of springback which takes place after the clamping device has been opened, with the other machine elements remaining in an unchanged position, available for assessment of the bending angle.

U.S. Pat. No. 5,992,210 describes a device for bending an endless tubular section. The device has feed unit, in each case one fixing unit for the tube section which is to be bent and the tube section which is not to be bent, and a pivot arm which brings the tube section to be bent into the desired shape. After the bending operation, the fixing device which is located at the pivot arm is released and the shape produced is recorded using sensors.

However, all the known methods for determining the three-dimensional geometry of a bent extruded section in particular of a bent tube, are afflicted with the drawback that the three-dimensional geometry is determined after the bending has taken place and the bent extruded section has been completely removed from the bending device. If it is necessary, for example, to form a number of different curves along a tube, with the bending operations for producing the individual curves being carried out in direct succession along the tube, the techniques which have previously been disclosed can only be used to record the fully bent end product in its entirety by metrology after the fully bent tube has been released from the bending device. If it emerges that one of the number of curves which have been formed is defective, for example if the actual bending angle deviates from the desired set bending angle, the entire bent tube has to be considered as a scrap product. If, for example, thin-walled tube systems are being used, as are employed, for example, as brake lines in the automotive sector, to remain with the example given above, the bent pipelines, which have a length of up to several meters, have only a low inherent stability, and consequently their actual bent three-dimensional shape cannot be measured without further auxiliary templates for supporting their weight.

However, accurate knowledge of the precise three-dimensional shape of the curves which have been produced by the bending operation and knowledge of the overall three-dimensional form of a bent pipeline which has actually been produced, in particular if a large number of curves are present along a pipeline, are particularly important for assessing quality control in particular in the case of pipelines which have to be inserted with an accurate fit into mating holders.

SUMMARY OF THE INVENTION

The invention is based on the object of providing a method and a device for determining the three-dimensional geometry of a bent extruded section which is held in a feed and fixing unit in the region along a first rectilinear center axis (A) of the extruded section and is bent through a predeterminable bending angle $\alpha$ by means of a bending device, in such a manner that the region of the first rectilinear center axis (A) adjoins one side of a region of the extruded section which has been produced by the bending operation and a region having a second rectilinear center axis (B) adjoins the opposite side, which is such that if a large number of bending operations are to be carried out in succession along the tube, each individual bending angle is to be determined accurately. Moreover, it is important to carry out the measurement by measuring further parameters which determine the three-dimensional geometry of the bent tube, so that after one bending operation has taken place it is immediately possible to ascertain whether the bending operation has achieved the desired bending result.

The solution to the object on which the invention is based is given in claim 1. The subject matter of claim 18 is a device for bending extruded sections which has been refined in accordance with the invention. Features which advantageously refine the idea of the invention form the subject matter of the subclaims and of the description and are to be found in the description with reference to the drawing.

To determine the bending angle produced by the operation of bending an extruded section, for example a tube, it is necessary for the bending operation to be carried out along a rectilinear section of the tube, so that after the bending operation has been carried out a curved tube region is obtained, which is adjoined on both sides by rectilinear tube sections. To simplify the explanation of this situation, the extruded section used is a tube, but it is also possible for the tube to be replaced by further alternatives, for example by round rods of solid material or other geometrically shaped extruded sections, such as flat materials, U-shaped or V-shaped extruded sections, to name but a few.

To determine the bending angle $\alpha$, it is now necessary to determine the precise position of the two center axes of the rectilinear tube sections which adjoin the curved tube section on either side.

On account of the spatially defined arrangement between the feed and fixing unit, which supplies and fixes the tube, and the bending device itself, into which the tube is guided in the unbent state along its rectilinear center axis (A), the three-dimensional position of the center axis (A) with respect to a basic system of coordinates is assumed to be known; this position is in any case also not changed by the bending operation. Therefore, after the bending process has taken place, it is only necessary to determine the three-dimensional position of the rectilinear center axis of that rectilinear region of the tube which follows the bending device as seen in the feed direction, i.e. that region of the rectilinear tube which projects beyond the bending device prior to the bending operation.

A contactless or tactile measurement sensor, the three-dimensional position of which with respect to the bending device and/or to the feed and fixing unit is known, is preferably used to determine the three-dimensional position of the corresponding center axis (B). The main aspect of the method according to the invention therefore consists in carrying out the determination of the three-dimensional position of the center axis (B) after the bending operation has been completed, i.e. after the tube has been released from the bending device, so that material-induced springback effect can also be recorded during the measurement operation, and while the tube is still fixed or held in the feed and fixing unit.

Accordingly, during the measurement the tube remains in a fixed position defined by the feed and fixing unit. Only in this way is it possible for the tube, after the measurement operation has been completed, to be transferred in a controlled manner from the "frozen" measurement position to a subsequent bending position relative to the bending device, so that a subsequent bending operation can be carried out on the tube in a fixed three-dimensional relationship with respect to the preceding bending operation.

However, if it emerges that during a bending operation the actual bending angle, taking account of the material-induced springback established by the bent tube being released from the bending device, deviates excessively from the desired bending angle, it is possible either to repeat the bending operation using the same or altered bending parameters or for the tube to be replaced with a new tube.

For quantitative and qualitative assessment of the bending result, the bending angle $\alpha$ which has been determined is compared with a predetermined set bending angle $\alpha_{set}$. If it emerges that deviations which go beyond a likewise predetermined tolerance range are occurring, a signal is generated, and this is used to initiate a range of further measures.

If a signal of this nature is received, it is possible first of all to make a qualitative statement as to the bending quality, such as for example scrap, not scrap, still acceptable, etc. For subsequent reworking of a bending operation, corrected bending parameters are determined and are used to repeat the bending operation in order to improve the bending result. It is also possible for the corrected bending parameter to be used as the basis for further bending operations along the extruded section, especially since it is quite possible for the materials properties to change along the extruded section, and these changes can also be taken into account in this way by means of the updated bending parameters.

In an advantageous refinement of the method according to the invention, it is proposed that, in addition to the recording of the bending angle as described above, the advancement length along the tube between two successive bending operations be recorded, in order to obtain accurate knowledge as to the distance between two curved tube regions. Moreover, it is also proposed to measure the rotation angle through which the tube is rotated along its center axis (A) over the course of two bending positions using a suitable rotation angle-measuring device. The overall three-dimensional shape of the bent pipeline can be recorded and determined on the basis of all the above information, namely the bending angle, the advancement length and the rotation angle relating to a large number of bending operations carried out on a pipeline.

However, it is not absolutely imperative to measure the rotation angle in order to determine a possible twisting between two successive bending operations. Since, as described above, the three-dimensional position of the center axis B is determined, this information can be used to determine not only the bending angle $\alpha$ lying in the plane described by the two center axes A and B, but also the angle through which the tube has been bent relative to the plane which is normal to the center axis A.

If the bending operation along an extruded section has ended, so that a desired extruded section which generally has a plurality of bends, is obtained on the basis of a predetermined bending plan, it is possible, by considering all the measured and stored measurement data together, to compare the actual three-dimensional shape of the bent extruded section with a set three-dimensional shape in accordance with the bending plan. This comparison is used primarily to check the quality of the product and for quality assurance.

A bending device, which carries out the above bending operation in accordance with the invention, for bending an extruded section, having a feed and fixing unit, by means of which the extruded section can be supplied as a rectilinear product sold by the meter and can be fixed in place, and having a bending device, which is arranged downstream of the feed and fixing unit, as seen in the feed direction, along a rectilinear center axis (A) of the extruded section, this bending device having a bending head, which comprises at least two bending bodies which, during the bending operation, at least partially surround the extruded section which is to be bent, with the local application of force, and can be transferred into an open position which releases the extruded section, is distinguished by the fact that a measurement sensor which is in a fixed three-dimensional relationship with respect to the feed and fixing unit and/or with respect to the bending device is provided, this sensor recording the three-dimensional position of a rectilinear center axis (B) of the extruded section in the region which directly follows the bending device, as seen in the feed direction of the extruded section. Furthermore, a storage and evaluation unit is provided, in which measured values for the measurement sensor can be stored and evaluated in such a manner that it is possible to determine an angle $\alpha$, known as the bending angle, which is included by the center axes (A) and (B). In this way, it is possible to ensure that information about the actual three-dimensional shape of the bent extruded section, which can be fed for further evaluation, continues to be obtained even after the bending operation has been completed.

BRIEF DESCRIPTION OF THE INVENTION

The invention is described below, by way of example and without restricting the general concept of the invention, on the basis of exemplary embodiments and with reference to the drawing, in which:

FIG. 1 diagrammatically depicts a device which has been designed in accordance with the invention for recording the three-dimensional geometry of a bent tube.

WAYS OF CARRYING OUT THE INVENTION, INDUSTRIAL APPLICABILITY

FIG. 1 diagrammatically depicts a device for bending and/or curving a tube 1 and for recording the three-dimensional geometry of the tube profile which has been bent by the bending operation. The tube 1, which is in the form of product which can be sold by the meter, passes via a feed unit 2, comprising two rollers, into a fixing unit 3, which is formed as a mating holder and through which the tube 1 is pushed along its rectilinear center axis A. Furthermore, there is a bending device 4, comprising an inner bending jaw 41 and an outer bending jaw 42, which can be moved into an open position in order for the tube 1 to be introduced. FIG. 1 shows the bending jaws 41 and 42 in the closed position. The operation of bending the tube 1 with the aid of the bending device 4 is carried out in such a manner that the outer bending jaw 42 deforms the tube, in a region 11 which is to be curved, by a rotary motion (cf. the arrow illustrated) with respect to the inner bending jaw 41. In the process, a rectilinear tube section 5, which prior to the bending operation is oriented longitudinally with respect to the center axis A, is inclined out of the original center axis A and, after the bending operation, has a rectilinear center axis B. The angle $\alpha$ included by the center axes A and B corresponds to the bending angle which is to be determined accurately after the bending operation has been completed.

The bending angle $\alpha$ is measured by determining the three-dimensional position of the center axis B which adjoins the tube section 5 which has just been curved. The center axis B, which at the same time also corresponds to the cylinder axis of the tube in the region 5, is determined with the aid of a contactless sensor 6 which is fixed to the outer bending jaw 42 and is therefore in a fixed three-dimensional relationship with respect to the bending device 4. Of course, it is also possible for the sensor 6 to be secured independently of the bending jaw 42, but if it is positioned in this way it must be ensured that a fixed three-dimensional relationship is retained between sensor 6 and the bending device 4 or the fixing unit 3.

The sensor 6 is a laser sensor which is based on the triangulation technique and has a camera unit 61 and two light sources 62 designed as linear lasers. With the aid of optics (not shown), this light section sensor 6 projects in each case one line per light source 62 onto the surface of the tube, and this line is detected by the camera unit 61. 3-D points on the tube surface are detected along the light lines with the aid of the light section sensor 6 and are used to determine the cylinder center axis, referred to as the center axis B, by cylinder approximation. The three-dimensional position of the center axis A can be assumed to be known, especially since it is defined by the feed and fixing unit 2, 3 and the bending device 4. The bending angle α between the two axes A and B with respect to the three-dimensional Cartesian coordinate system X-Y-Z can be determined from the three-dimensional positions of the center axes A and B which have been determined in this way. Moreover, it is also possible to use the information to determine the angle at which the center axis B intersects the Y or Z axis. This is at the same time the rotation angle of the tube about the center axis.

In a further preferred embodiment, the sensor 6 or an additional measuring unit is used to record the external three-dimensional shape of the extruded section, for example to detect flattening in the case of a tube being used as the extruded section. Flattening of this nature may occur during the bending operation but should be specifically avoided, for example by correcting bending parameters during subsequent bending operations or by carrying out suitable recorrection measures.

Furthermore, it is possible, using variables which have likewise been determined for advancement V and rotation angle D of the unbent tube 1 which is supplied and the angle α which has been recorded by metrology, to determine the three-dimensional geometry, in a stepwise manner, of a tube composed of a multiplicity of individual rectilinear tube segments and curves. This is achieved by adding all the data about the individual tube sections, so that at the end of the bending operation the complete three-dimensional shape of the bent tube is available.

The profile of the neutral fiber 7 inside the tube 1, in particular in the region of the curves 5, at which the neutral fiber 7 is displaced from the center of the tube toward the internal radius, is taken into account in the form of parameters when determining the length of the straight sections 5. The parameters are determined as a function of the bending angle, tube diameter, tube material and tube wall thickness.

The device illustrated in FIG. 1 for determining the geometric shape of tubes during the bending process in the machine allows direct assessment of the quality of the shape and configuration of a bent tube. In particular, bending angle errors which occur during the bending process are detected immediately. The cause of these errors is in particular the bent tube springing back after the bending operation, this being caused, inter alia, by fluctuations in the materials properties.

List of Reference Symbols

1 tube
2 feed device
3 fixing unit
4 bending device
41 inner bending jaw
42 outer bending jaw
5 straight tube section
6 triangulation laser sensor
61 camera
62 linear laser
7 neutral fiber

The invention claimed is:

1. A method for determining the three-dimensional geometry of a bent extruded section comprising:

holding the extruded section in a feed and fixing unit in a region along a first rectilinear center axis (A) of the extruded section;

bending the extruded section through a predeterminable bending angle α by means of a bending device;

wherein the region of the first rectilinear center axis (A) adjoins one side of a bent region of the extruded section which has been produced by the bending operation;

wherein a region having a second rectilinear center axis (B) adjoins the opposite side;

wherein the three-dimensional position of the second rectilinear center axis (B) is determined relative to the known three-dimensional position of the first rectilinear center axis (A) of the extruded section while the extruded section is being held in a three-dimensional fixed position by the feed and fixing unit and the bent region of the extruded section is being released from the bending device;

wherein the bending angle α is determined by forming a section between the two axes (A) and (B);

wherein the extruded section is displaced and/or rotated along the feed and fixing unit;

wherein a further bending operation is carried out at a further location comparable to the first bending operation in the region along the first rectilinear center axis (A) of the extruded section;

wherein a bending angle α' obtained by the further bending operation is determined, wherein the advance of the extruded section along the feed and fixing unit between two successive bending operations is recorded; and wherein the rotation angle through which the extruded section is rotated between two successive bending operations is recorded.

2. The method as claimed in claim 1, wherein the extruded section is supplied longitudinally to the feed and fixing unit in unbent, rectilinear form as a product sold by the meter.

3. The method as claimed in claim 1, wherein the three-dimensional position of the second rectilinear center axis (B) is determined with the aid of a contactless measurement method.

4. The method as claimed in claim 3, wherein the contactless measurement method used is a 3-D light section method which is based on triangulation and in which a plurality of three-dimensional points on the surface of the extruded section in the region of the rectilinear center axis (B) are determined and the three-dimensional position of the center axis (B) is determined by means of mathematical approximation.

5. The method as claimed in claim 4, wherein the mathematical approximation is based on minimizing the lowest error sum of squares.

6. The method as claimed in claim 1, wherein the bending angle α is determined by way of triangulation.

7. The method as claimed in claim 1, wherein the determined bending angle α is compared with a set bending angle $\alpha_{set}$ and a signal is generated in the event of a deviation by a tolerance range.

8. The method as claimed in claim 7, wherein the signal is used to correct bending parameters which control the bending operation performed by the bending device.

9. The method as claimed in claim 8, wherein the corrected bending parameters are used for a subsequent bending operation on the region of the extruded section which has already been bent, for recorrection purposes.

10. The method as claimed in claim 7, wherein the corrected bending parameters are made available for further bending operations along the extruded section.

11. The method as claimed in claim 1, wherein a multiplicity of bending operations are carried out successively, with associated bending angles in each case being determined.

12. The method as claimed in claim 1, wherein after a multiplicity of bending operations has been carried out the entire three-dimensional geometry of the bent extruded section is determined on the basis of all the recorded data, namely bending angle, advancement length and/or rotation angle.

13. The method as claimed in claim 1, wherein the cross-sectional shape of the extruded section is recorded.

14. The method as claimed in claim 12, wherein the three-dimensional geometry, which has been recorded by metrology, of the bent extruded section is compared with a predetermined set three-dimensional geometry, and wherein quality assessment is carried out on the basis of the comparison.

15. A device for bending an extruded section and determining the three-dimensional geometry thereof, comprising:

a feed and fixing unit by means of which the extruded section can be supplied as a rectilinear product provided by the meter and can be fixed in place;

a bending device arranged downstream of the feed and fixing unit along a rectilinear center axis (A) of the extruded section; the bending device having a bending head comprising at least two bending bodies;

the bending head at least partially surrounding the extruded section which is to be bent during the bending operation with the local application of force;

wherein the bending head can be transferred into an open position which releases the extruded section;

a measurement sensor which is in a fixed three-dimensional relationship with respect to the feed and fixing unit and/or with respect to the bending device;

the sensor recording the three-dimensional position of a rectilinear center axis (B) of the extruded section in the region which directly follows the bending device as seen in the feed direction of the extruded section;

a storage and evaluation unit in which measured values for the measurement sensor can be stored and evaluated in such a manner that it is possible to determine a bending angle $\alpha$, which is included by the center axes (A) and (B);

a distance-measuring unit in the region of the rectilinear center axis (A) to record a length advance of the extruded section relative to the feed and fixing unit;

a rotation angle-measuring unit in the region of the rectilinear center axis (A) to record a rotation angle through which the extruded section is rotated relative to the rectilinear center axis (A); and wherein measured values from said distance-measuring unit and said rotation angle-measuring unit can be stored and evaluated in said storage and evaluation unit in such a manner that if the bending angle $\alpha$ is known it is possible to determine the entire three-dimensional geometry of the extruded section.

16. The device as claimed in claim 15, wherein the measurement sensor is connected to the feed and fixing unit or the bending device.

17. The device as claimed in claim 15, wherein the measurement sensor is an optical measurement sensor.

18. The device as claimed in claim 17, wherein the optical measurement sensor has at least two light sources and at least one light-sensitive sensor.

19. The device as claimed in claim 18, wherein the light-sensitive sensor is a sensor with three-dimensional resolution.

20. The device as claimed in claim 17, wherein the optical measurement sensor is a laser triangulation sensor.

21. The device as claimed in claim 15, wherein the extruded section is designed as a tube or as flat material.

* * * * *